US006935116B2

(12) United States Patent
Stuttaford et al.

(10) Patent No.: US 6,935,116 B2
(45) Date of Patent: Aug. 30, 2005

(54) FLAMESHEET COMBUSTOR

(75) Inventors: Peter J. Stuttaford, Jupiter, FL (US); Stephen Jennings, Palm City, FL (US); Andrew Green, Jupiter, FL (US); Ryan McMahon, North Palm Beach, FL (US); Yan Chen, Palm Beach Gardens, FL (US); Hany Rizkalla, Stuart, FL (US); John Carella, Jupiter, FL (US); Vamsi Duraibabu, Jupiter, FL (US); Martin Spalding, Jupiter, FL (US)

(73) Assignee: Power Systems Mfg., LLC, Jupiter, FL (US)

( * ) Notice: Subject to any disclaimer, the term of this patent is extended or adjusted under 35 U.S.C. 154(b) by 31 days.

(21) Appl. No.: 10/424,350

(22) Filed: Apr. 28, 2003

(65) Prior Publication Data

US 2004/0211186 A1 Oct. 28, 2004

(51) Int. Cl.[7] ..... F02C 3/00; F02C 7/22; F23R 3/14; F23R 3/54

(52) U.S. Cl. ..... 60/737; 60/746; 60/747; 60/748; 60/760

(58) Field of Search ..... 60/737, 739, 746, 60/747, 748, 760, 776, 773

(56) References Cited

U.S. PATENT DOCUMENTS

| | | | | | |
|---|---|---|---|---|---|
| 2,446,059 | A | * | 7/1948 | Peterson et al. | 60/760 |
| 2,621,477 | A | * | 12/1952 | Powter et al. | 60/746 |
| 3,121,996 | A | * | 2/1964 | Smith | 60/748 |
| 3,169,367 | A | * | 2/1965 | Hussey | 60/39.37 |
| 4,050,238 | A | * | 9/1977 | Holzapfel | 60/737 |
| 4,112,676 | A | | 9/1978 | DeCorso | |
| 4,735,052 | A | * | 4/1988 | Maeda et al. | 60/746 |
| 5,121,597 | A | * | 6/1992 | Urushidani et al. | 60/778 |
| 5,231,833 | A | * | 8/1993 | MacLean et al. | 60/739 |
| 5,319,935 | A | | 6/1994 | Toon et al. | |
| 5,321,949 | A | * | 6/1994 | Napoli et al. | 60/739 |
| 5,640,851 | A | | 6/1997 | Toon et al. | |
| 5,647,215 | A | | 7/1997 | Sharifi et al. | |
| 5,761,906 | A | * | 6/1998 | Norster | 60/737 |
| 5,765,376 | A | * | 6/1998 | Zarzalis et al. | 60/748 |
| 5,983,642 | A | | 11/1999 | Parker et al. | |
| 6,151,899 | A | * | 11/2000 | Park | 60/748 |
| 6,209,325 | B1 | * | 4/2001 | Alkabie | 60/748 |
| 6,253,555 | B1 | | 7/2001 | Willis | |
| 6,345,505 | B1 | * | 2/2002 | Green | 60/748 |
| 6,374,615 | B1 | * | 4/2002 | Zupanc et al. | 60/748 |
| 6,513,334 | B2 | | 2/2003 | Varney | |
| 6,532,726 | B2 | * | 3/2003 | Norster et al. | 60/748 |
| 6,609,376 | B2 | * | 8/2003 | Rokke | 60/748 |
| 2002/0020173 | A1 | * | 2/2002 | Varney | 60/746 |

OTHER PUBLICATIONS

Richard J. Antos, Westinghouse Combustion Development 1996 Technology Update, Power Generation Combustion Turbine Technology 50 Years of Progress Section 8 pp. 2–11.

* cited by examiner

*Primary Examiner*—Ted Kim
(74) *Attorney, Agent, or Firm*—Brian R. Mack

(57) ABSTRACT

A gas turbine combustion system having reduced emissions and improved flame stability at multiple load conditions is disclosed. The improved combustion system accomplishes this through complete premixing, a plurality of fuel injector locations, combustor geometry, and precise three dimensional staging between fuel injectors. Axial, radial, and circumferential fuel staging is utilized including fuel injection proximate air swirlers. Furthermore, strong recirculation zones are established proximate the introduction of fuel and air premixture from different stages to the combustion zone. The combination of the strong recirculation zones, efficient premixing, and staged fuel flow thereby provide the opportunity to produce low emissions combustion at various load conditions.

18 Claims, 9 Drawing Sheets

FLAMESHEET COMBUSTOR

BACKGROUND OF THE INVENTION

1. Field of the Invention

This invention relates in general to gas turbine combustion systems and specifically to a gas turbine combustion system that can operate at significantly lower load conditions while having stable combustion and lower emissions.

2. Description of Related Art

In an effort to reduce the amount of pollution emissions from gas-powered turbines, governmental agencies have enacted numerous regulations requiring reductions in the amount of oxides of nitrogen (NOx) and carbon monoxide (CO). Lower combustion emissions can often be attributed to a more efficient combustion process, with specific regard to fuel injector location and mixing effectiveness.

Early combustion systems utilized diffusion type nozzles, where fuel is mixed with air external to the fuel nozzle by diffusion, proximate the flame zone. Diffusion type nozzles produce high emissions due to the fact that the fuel and air burn stoichiometrically at high temperature to maintain adequate combustor stability and low combustion dynamics.

An enhancement in combustion technology is the utilization of premixing, such that the fuel and air mix prior to combustion to form a homogeneous mixture that burns at a lower temperature than a diffusion type flame and produces lower NOx emissions. Premixing can occur either internal to the fuel nozzle or external thereto, as long as it is upstream of the combustion zone. An example of a premixing combustor of the prior art is shown in FIG. 1. A combustor 8 has a plurality of fuel nozzles 18, each injecting fuel into a premix cavity 19 where fuel mixes with compressed air from plenum 10 before entering combustion chamber 20. Premixing fuel and air together before combustion allows for the fuel and air to form a more homogeneous mixture, which will burn more completely, resulting in lower emissions. However, in this configuration the fuel is injected in relatively the same plane of the combustor, and prevents any possibility of improvement through altering the mixing length.

An alternate means of premixing and lower emissions is through multiple combustion stages, which allows for enhanced premixing as load increases. Referring now to FIG. 2, an example of a prior art multi-stage combustor is shown. A combustor 30 has a first combustion chamber 31 and a second combustion chamber 32 separated by a venturi 33, which has a narrow throat region 34. While combustion can occur in either first or second combustion chambers or both chambers, depending on load conditions, the lowest emissions levels occur when fuel, which is injected through nozzle regions 35, is completely mixed with compressed air in first combustion chamber 31 prior to combusting in second combustion chamber 32. The amount of load turndown is limited by the decreasing flame temperature as the load is decreased, making the flame unstable to the point where flashback occurs into the first combustion chamber. Therefore, this multi-stage combustor with a venturi is more effective at higher load conditions. While a full load condition is the most common operating point for land-based gas turbines used for generating electricity, often times electricity demands do not require the full load of the generator, and the operator desires to operate the engine at a lower load setting, such that only the load demanded is produced, thereby saving fuel costs. Combustion systems of the prior art have been known to become unstable at lower load settings while also producing unacceptable levels of NOx and CO emissions at lower load settings, especially below 50% load. This is primarily due to the fact that most combustion systems are staged for most efficient operation at high load settings. The combination of potentially unstable combustion and higher emissions often times prevents engine operators from running engines at lower load settings, forcing the engines to either run at higher settings, thereby burning additional fuel, or shutting down, and thereby losing valuable revenue that could be generated from the part-load demand. A further problem with shutting down the engine, is the additional cycles that are incurred by the engine hardware. A cycle is commonly defined as the engine passing through the normal operating envelope. Engine manufacturers typically rate hardware life in terms of operating hours or equivalent operating cycles. Therefore, incurring additional cycles can reduce hardware life requiring premature repair or replacement at the expense of the engine operator. What is needed is a system that can provide flame stability and low emissions benefits at a part load condition, as well as at a full load condition, such that engines can be efficiently operated at lower load conditions, thereby eliminating the wasted fuel when high load operation is not demanded or incurring the additional cycles on the engine hardware when shutting down.

SUMMARY AND OBJECTS OF THE INVENTION

The present invention discloses a gas turbine combustion system for reducing polluting emissions such as NOx and CO, while being able to provide stable combustion at lower load conditions. The combustion system contains a casing having a center axis, which is in fluid communication with the engine compressor, and an end cover fixed to the casing. In the preferred embodiment, the end cover contains a plurality of first injectors arranged in a first array about the end cover and a plurality of second injectors arranged in a second array about the end cover, with the second array radially outward of the first array. Located proximate the end cover is a first swirler having a plurality of passageways oriented generally perpendicular to the casing center axis for inducing a swirl generally radially inward to a first portion of the compressed air. Fuel, which is injected through the first and second injectors, mixes with the first portion of compressed air from the first swirler before entering a liner through a dome section. Additional fuel is also introduced to a second portion of compressed air through a plurality of third injectors located in a manifold of an aft injector assembly. The third injectors are divided into multiple circumferential sectors to allow for various fuel staging circumferentially around the aft injector assembly. To enhance mixing between fuel from the third injectors and second portion of compressed air, a second swirler is positioned adjacent the aft injector assembly for imparting a swirl to the second portion of compressed air. This fuel and air mixes in a second passage located between a first part of the liner and the dome prior to entering the liner and mixing with the fuel and first portion of compressed air from the first swirler region. Upon entering the liner, the premixture from the second passage must undergo a complete reversal of flow direction that causes strong recirculation zones at the forward end of the liner. These recirculation zones help to increase combustor stability by providing a region where a portion of the hot combustion gases can be entrained and recirculate to provide continuous ignition to the incoming premixed fuel and compressed air. Fuel flow to each of the first, second, and third sets of injectors is controlled independently to allow for fuel staging throughout various load conditions to control NOx and CO emissions at each load setting.

It is an object of the present invention to provide a combustion system having low NOx and CO at multiple operating conditions.

It is a further object of the present invention to provide a combustion system having a stable combustion process throughout all operating conditions.

In accordance with these and other objects, which will become apparent hereinafter, the instant invention will now be described with particular reference to the accompanying drawings.

DETAILED DESCRIPTION OF THE PREFERRED EMBODIMENT

Figure 1:
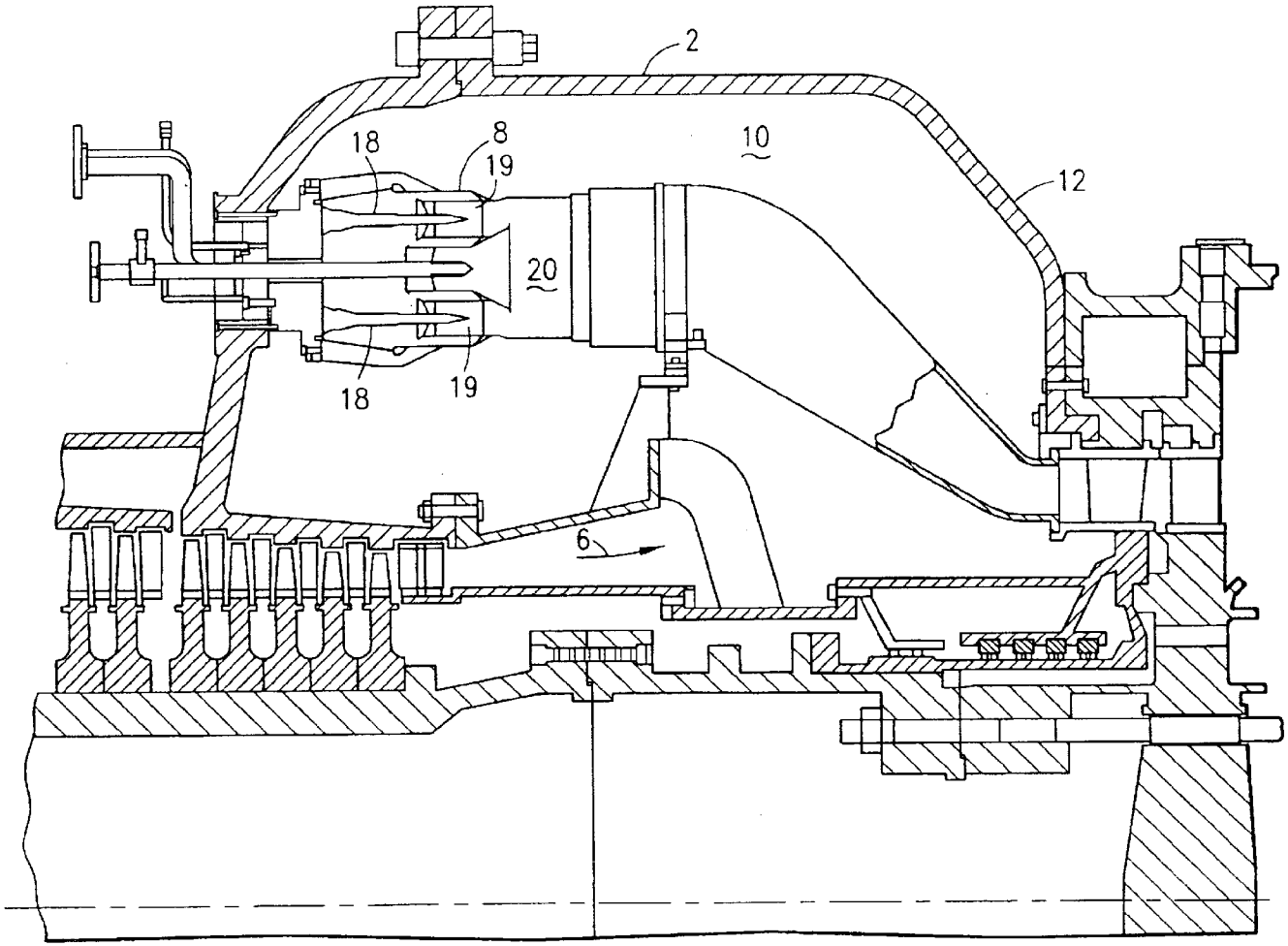
FIG. 1 PRIOR ART
FIG. 1 is a cross section view of a portion of a gas turbine engine containing a combustion system of the prior art.
Figure 2:
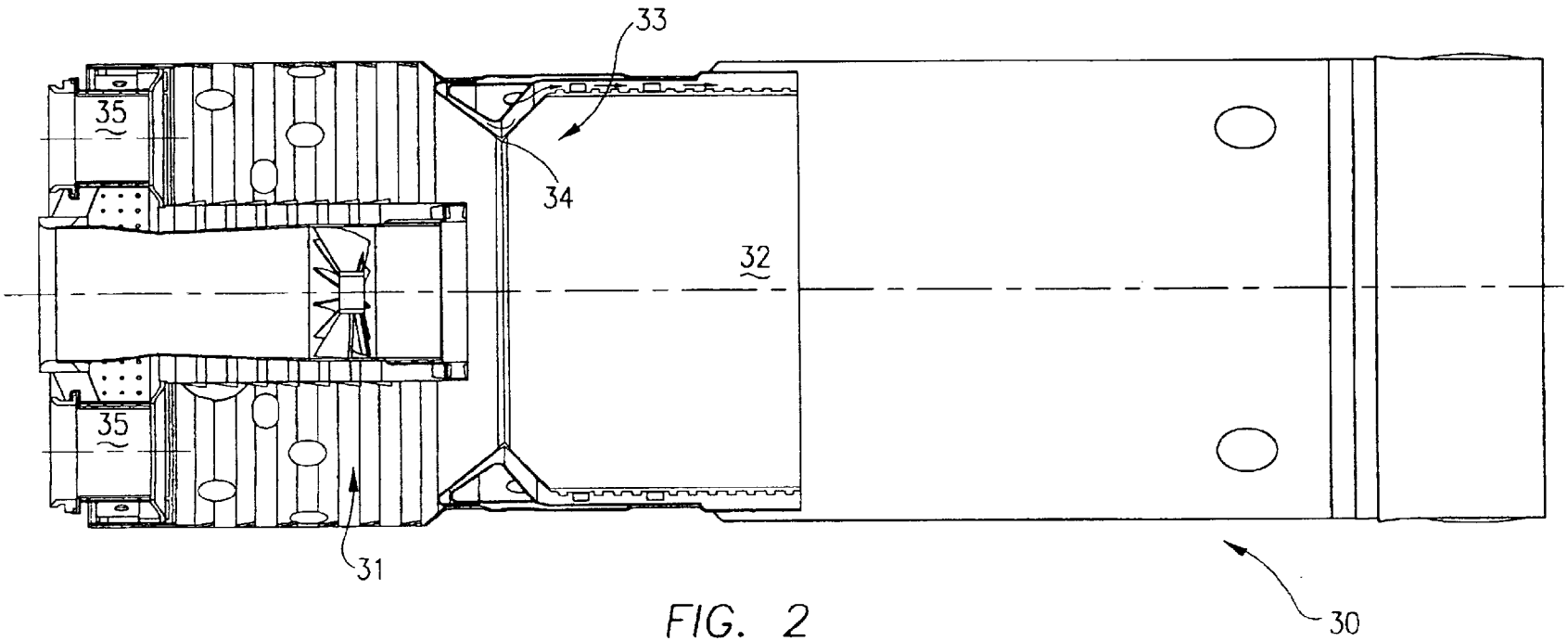
FIG. 2 PRIOR ART
FIG. 2 is a cross section view of an alternate combustion system of the prior art.
Figure 3:
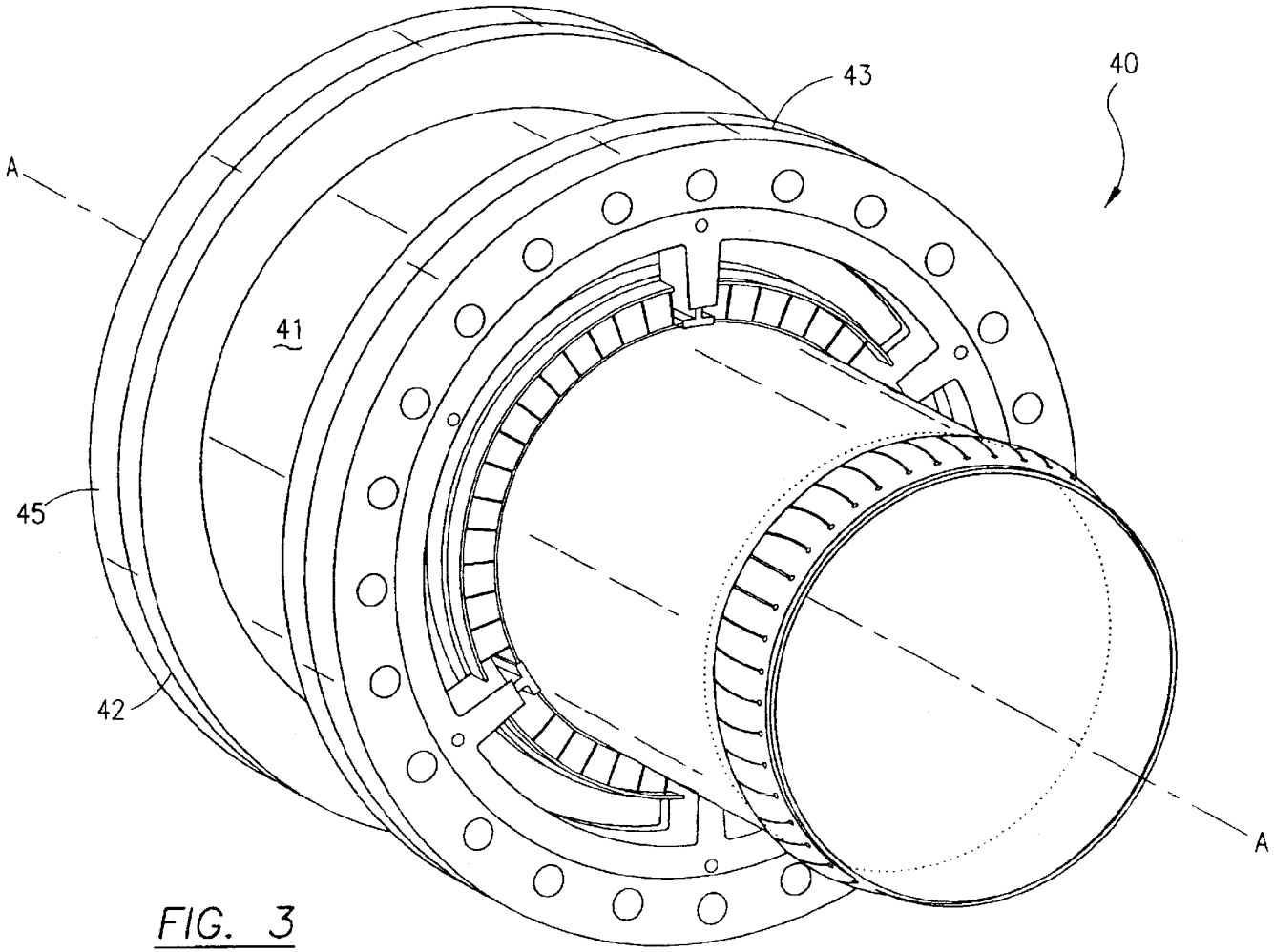
FIG. 3 is a perspective view of the present invention.
Figure 4:
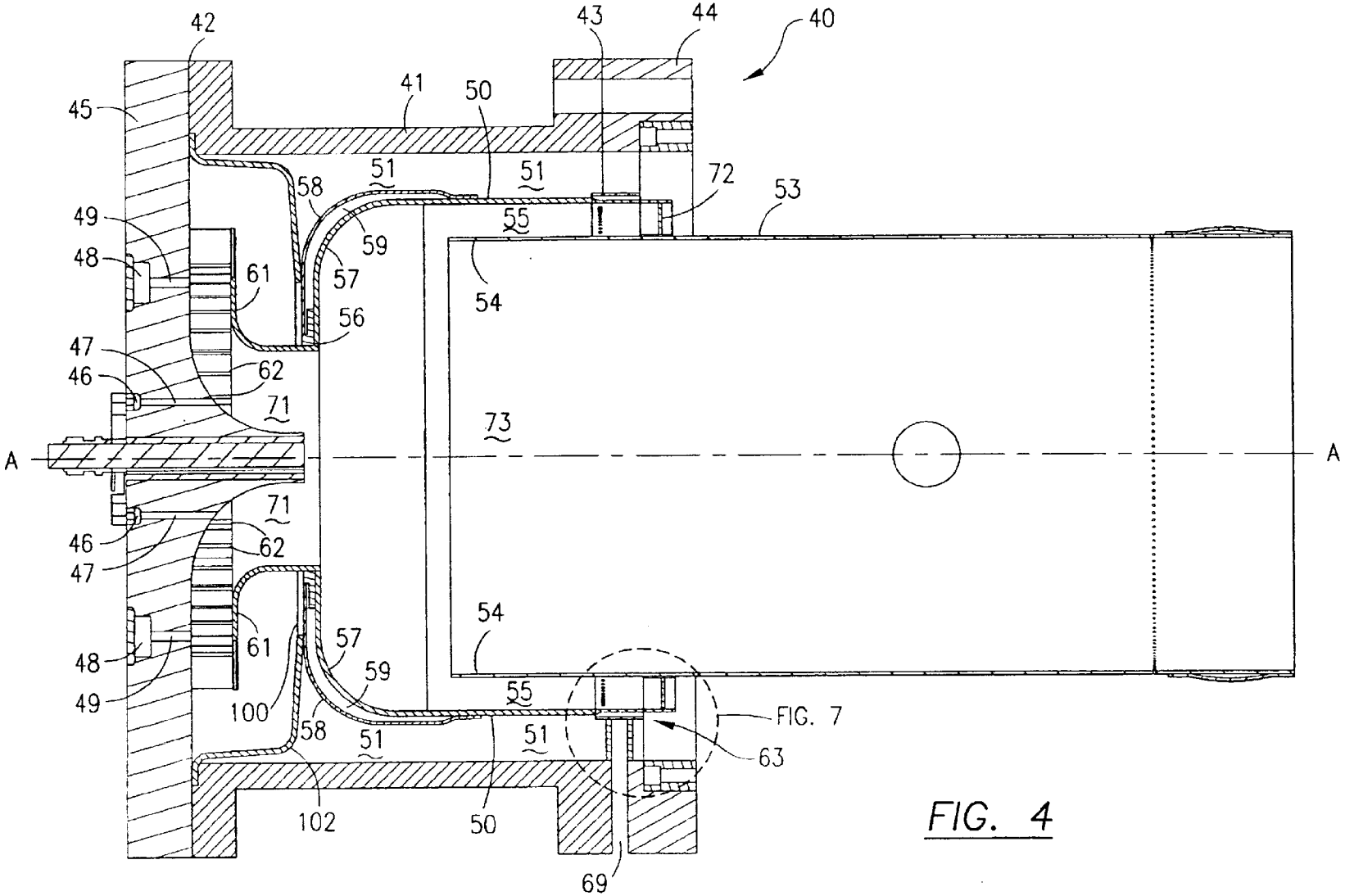
FIG. 4 is a cross section view of the present invention.

The preferred embodiment of the present invention will now be described in detail with specific reference to FIGS. 3–8. Referring now to FIGS. 3 and 4, a gas turbine combustion system 40 of the present invention is shown. Combustion system 40 includes a casing 41 having a first end 42, a second end 43, and a center axis A—A. Casing 41, which is mounted to an engine through flange 44, is in fluid communication with compressed air from a compressor.

Figure 5:
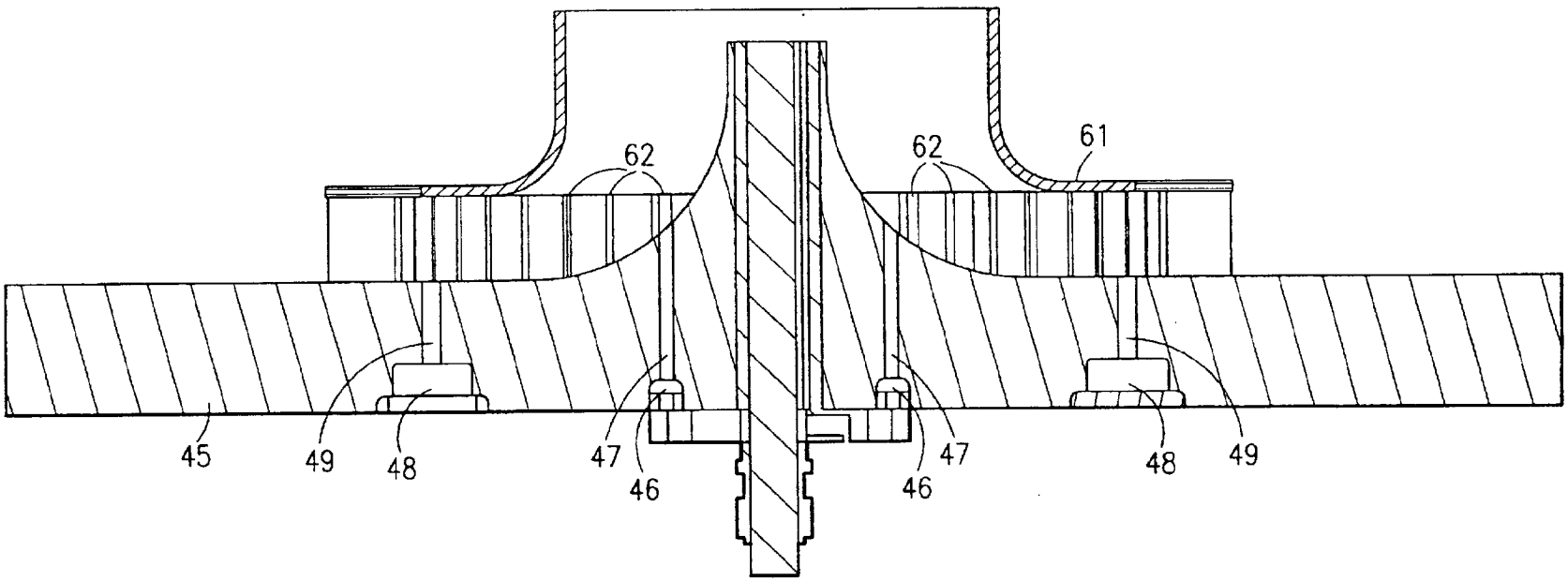
FIG. 5 is a detailed cross section view of the end cover of the present invention.

Referring now to FIGS. 4 and 5, an end cover 45 is fixed to casing first end 42, with end cover 45 having at least one fuel source in fluid communication with at least one set of injectors. In the preferred embodiment a first fuel source 46 is in fluid communication with a plurality of first injectors 47, where first injectors 47, comprising at least two injectors, are arranged in a first array radially outward of center axis A—A. Furthermore, the preferred embodiment of end cover 45 also contains a second fuel source 48 in fluid communication with a plurality of second injectors 49, where second injectors 49 are arranged in a second array radially outward of first injectors 47. As with first injectors 47 it is preferred that second injectors 49 comprises at least two injectors.

Figure 6:
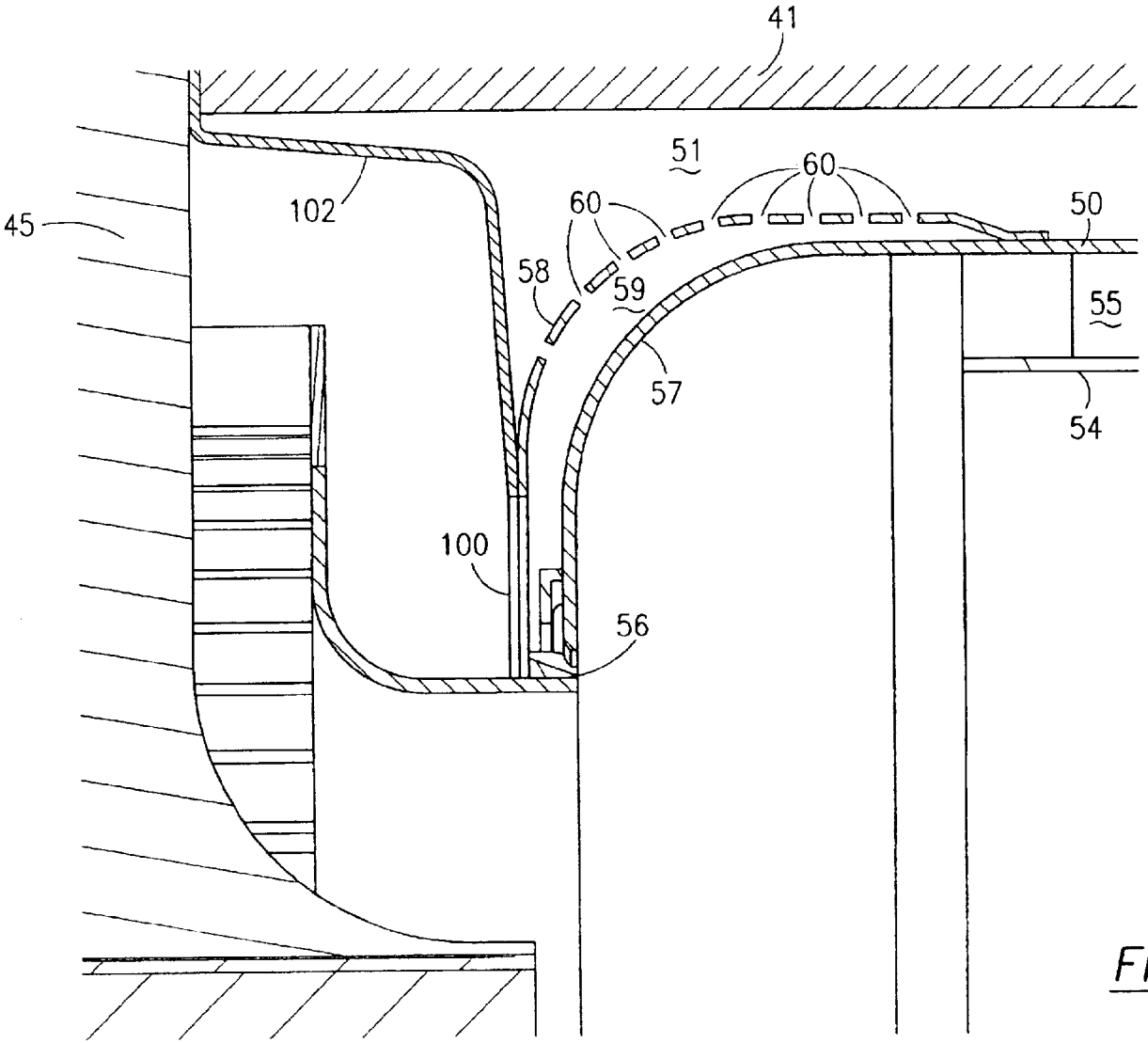
FIG. 6 is a detailed cross section view of a portion of the dome of the present invention.

Referring now to FIGS. 4 and 6, a dome 50 is located radially inward from casing 41, thereby forming, a first passage 51. Also located radially inward from casing 41 is a liner 53, having a first part 54 located radially inward from dome 50, thereby forming a second passage 55 between dome 50 and first part 54 of liner 53. Dome 50 also contains a first opening 56, an inner dome wall 57, and an outer dome wall 58, where inner dome wall 57 and outer dome wall 58 have a third passage 59 therebetween. An additional feature of dome 50 is the plurality of first feed holes 60 in outer dome wall 58 that extend from third passage 59 to first passage 51.

Referring back to FIGS. 4 and 5, a first swirler 61 is positioned adjacent end cover 45 and has a plurality of passageways 62. First swirler 61 is oriented such that a first portion of compressed air from the engine compressor passes through the plurality of passageways 62 prior to entering the liner. Passageways 62 are oriented generally perpendicular to the center axis A—A such that the first portion of compressed air is introduced radially into swirler 61.

Figure 7:
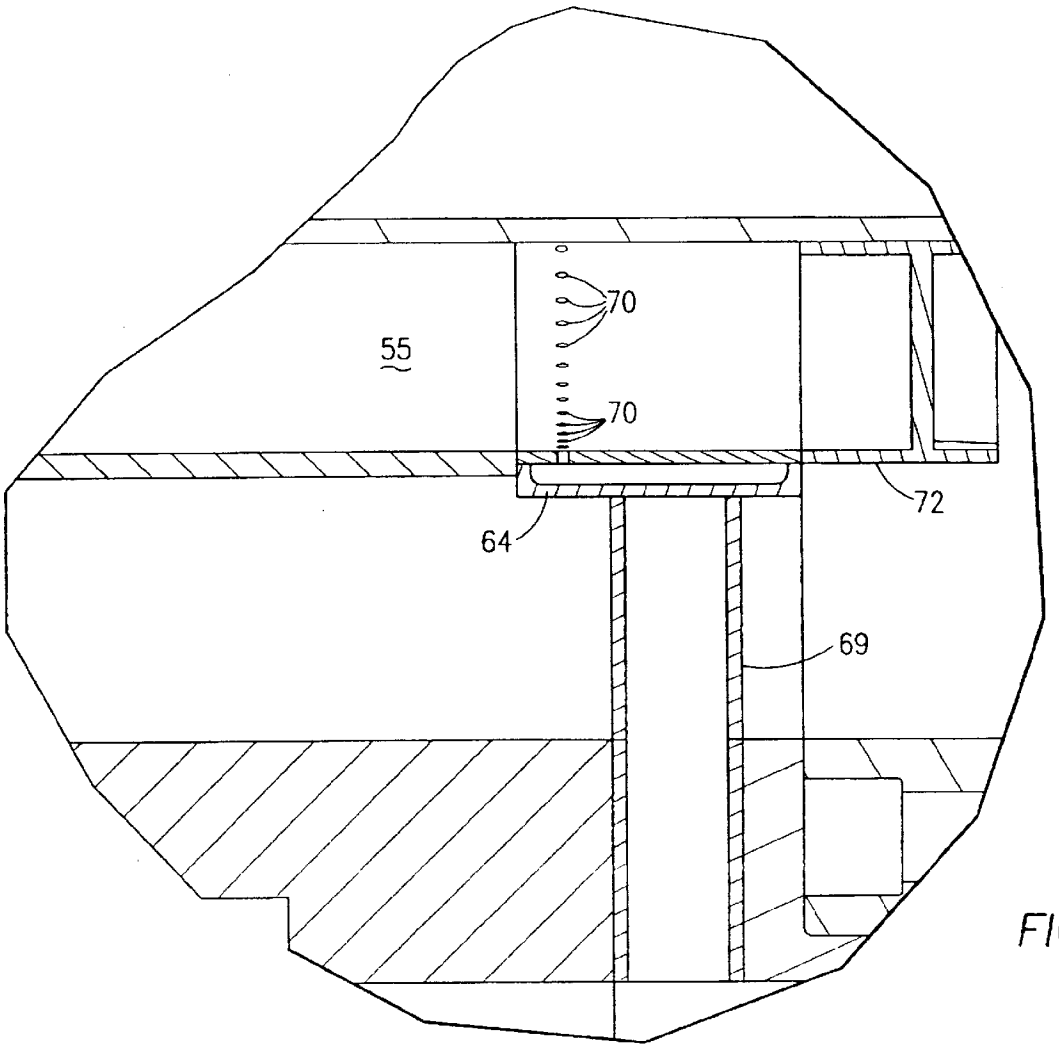
FIG. 7 is a detailed cross section view of a portion of the aft injector assembly of the present invention.
Figure 8:
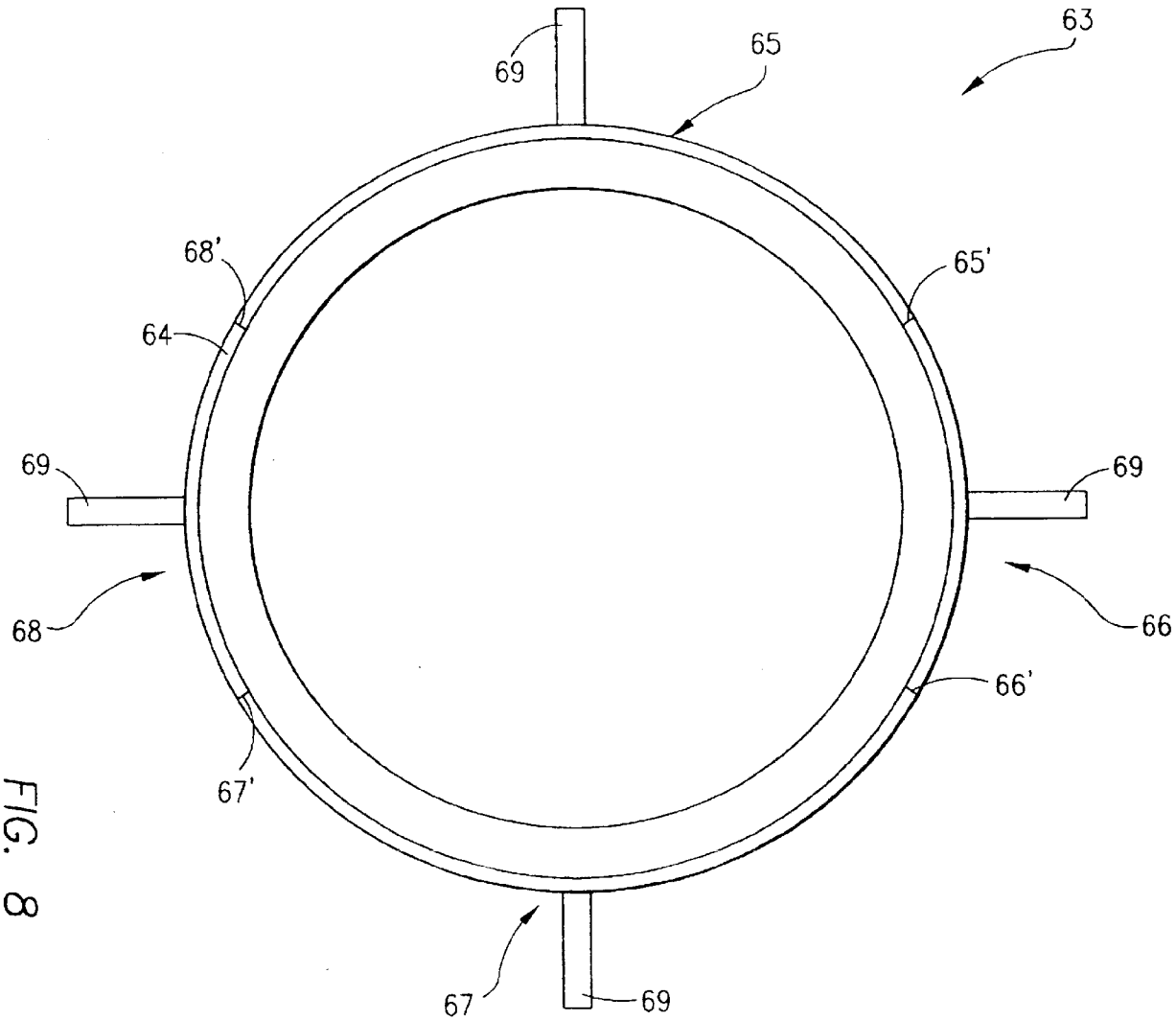
FIG. 8 is a detailed cross section view of the aft injector assembly of the present invention.

The combustion system of the present invention further contains an aft injector assembly 63, which is shown in FIGS. 4, 7, and 8. Aft injector assembly 63 contains a manifold 64 having at least one sector. In the preferred embodiment of the present invention, manifold 64 contains a plurality of sectors 65, 66, 67, and 68, with each of the sectors in fluid communication with a another fuel source 69. Each of the sectors 65, 66, 67, and 68 is isolated from adjacent sectors by a manifold wall 65', 66', 67', and 68' so that fuel supplied to one of the sectors does not flow into another sector of the aft injector assembly 63. Valve means (not shown) permit the fuel flow to each sector to be controlled independent of the other sectors. Located in manifold 64 is a plurality of third injectors 70 that inject a fuel into second passage 55. Each of the third injectors 70 is connected to only one of the sectors 65, 66, 67, or 68, so that all of the fuel that flows through a particular injector 70 during engine operation is supplied by a single sector 65, 66, 67, or 68.

The combustion system of the present invention utilizes premixing fuel and air prior to combustion in combination with precise staging of fuel flow to the combustor to achieve the reduced emissions at multiple operating load conditions. In operation, casing 41 is in fluid communication with compressed air from a compressor. First passage 51 between casing 41 and dome 50 receives a first portion of the compressed air. The first portion of compressed air then passes into third passage 59, which is located between inner dome wall 57 and outer dome wall 58, by way of a plurality of first feed holes 60, in order to cool inner dome wall 57. The first portion of compressed air then flows through a second opening 100 in a dome baffle 102, and then enters first swirler 61, passes through passageways 62, and is directed generally radially inward toward center axis A—A, at which point fuel is introduced to the swirling air through first injectors 47 and second injectors 49, with second injectors 49 located proximate passageways 62 of first swirler 61. The fuel and air premixture from first injectors 47, second injectors 49, and first swirler 61 then passes through a fourth passage 71 that directs the premixture through first opening 56 in dome 50. Meanwhile, a second portion of compressed air from the compressor passes through a second swirler 72, which is located adjacent aft injector assembly 63, and imparts the second portion of air with a swirl prior to mixing with fuel from aft injector assembly 63. The second portion of compressed air and fuel from aft injector assembly 63 mixes in second passage 55 and then, due to the geometry of dome 50, reverses direction prior to entering combustion zone 73. Therefore, fluid in first passage 51 and second passage 55 travel in a direction generally opposite to that of combustion products flowing through liner 53. The premixture from fourth passage 71 mixes with the premixture from second passage 55 proximate combustion zone 73. Depending on the load condition, some or all of the fuel injectors may be in use, with all fuel injectors being used at the highest load condition. The fuel is injected at flow rates and at different stages in order to generate the necessary amount of premixing to maintain low emissions throughout the operating spectrum.

Figure 9:
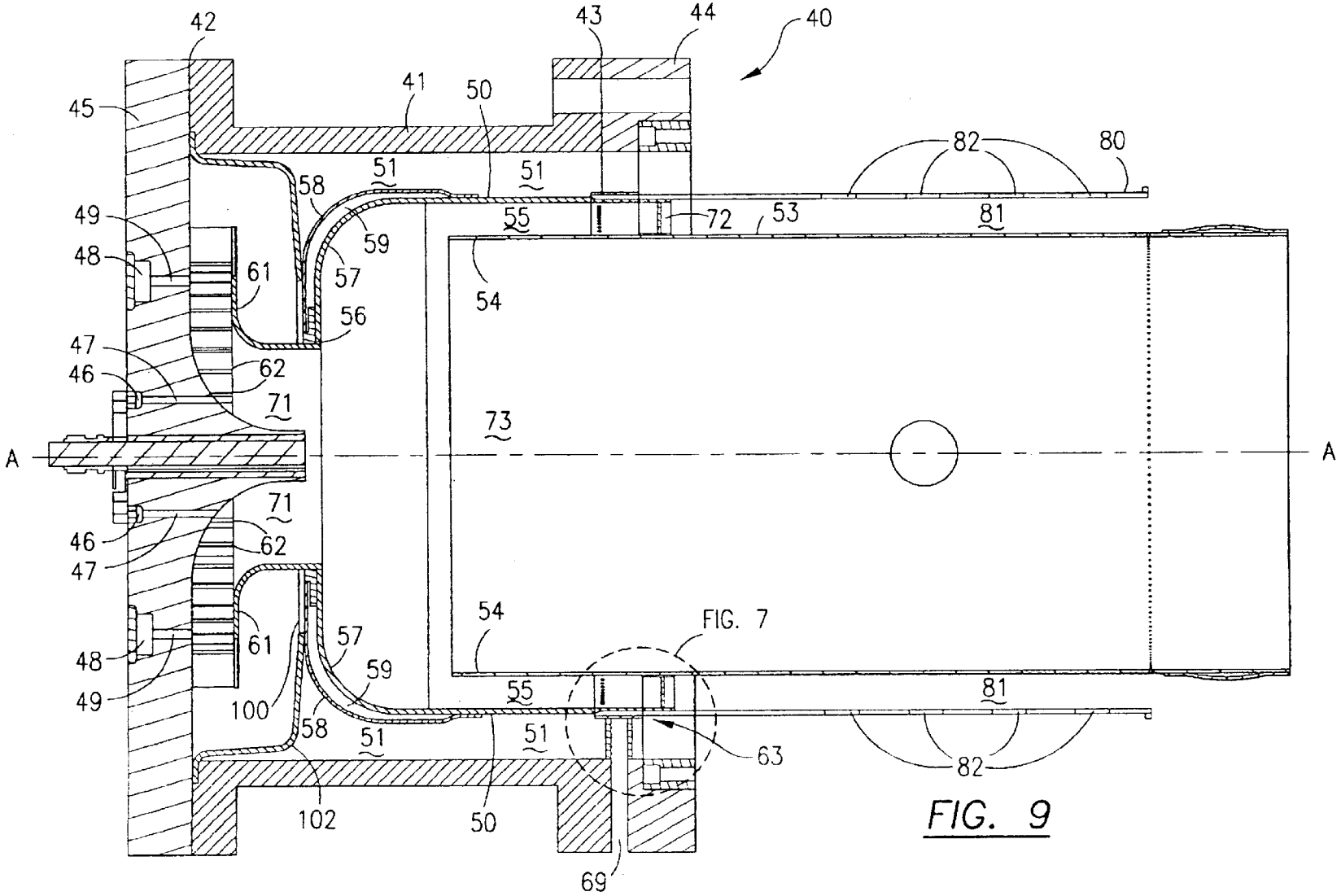
FIG. 9 is a cross section view of an alternate embodiment of the present invention.

An alternate embodiment of the present invention is shown in cross section in FIG. 9. Included is the addition of sleeve 80, which is coaxial with center axis A—A and is used for directing the second portion of compressed air to more effectively cool liner 53, as well as to smooth air flow non-uniformity from the engine compressor. Sleeve 80 is positioned radially outward of liner 53 and aft of dome 50 such as to form a fifth passage 81 between sleeve 80 and liner 53 that is in fluid communication with second swirler 72 and second passage 55. In order to supply compressed air to fifth passage 81 to more effectively cool liner 53, a plurality of second feed holes 82 are placed about sleeve 80. Due to pressure changes across second feed holes 82, a jet of air is created that impinges on the outside of liner 53 to cool the surface prior to the compressed air being directed through second swirler 72 and mixing with fuel from aft injector assembly 63. It should be noted that all other elements of the alternate embodiment of the present invention are the same as the preferred embodiment, and therefore do not require further discussion.

While the invention has been described in what is known as presently the preferred embodiment, it is to be understood that the invention is not to be limited to the disclosed embodiment but, on the contrary, is intended to cover various modifications and equivalent arrangements within the scope of the following claims.

What we claim is:

1. A gas turbine combustion system comprising:

a casing having a first end, a second end, and a center axis, with said casing in fluid communication with compressed air from a compressor;

an end cover fixed to said casing first end, said end cover having a first swirler having a plurality of passageways extending therethrough and at least one set of injectors in fluid communication with at least one fuel source, said passageways oriented generally perpendicular to said axis, and said one set of injectors located immediately adjacent to said first swirler for injecting fuel from said one fuel source at said first swirler;

a dome located radially inward from said casing thereby forming a first passage between said casing and said dome, said dome having a first opening;

a liner located radially inward from said casing, said liner having a first part located radially inward from at least a portion of said dome, thereby forming a second passage between said portion of said dome and said first part of said liner;

an aft injector assembly located radially outward of said liner and radially inward of said casing, said aft injector assembly comprising:

a manifold having at least one injection sector;

another fuel source in fluid communication with said manifold;

a plurality of third injectors located in said manifold to inject fuel into said second passage.

2. The gas turbine combustion system of claim 1 wherein said dome contains an inner dome wall and outer dome wall having a third passage therebetween.

3. The gas turbine combustion system of claim 2 wherein said outer dome wall contains a plurality of first feed holes extending from said third passage to said first passage.

4. The gas turbine combustion system of claim 1 wherein said at least one set of injectors comprises a plurality of first injectors in a first array radially outward of said center axis and a plurality of second injectors, said plurality of second injectors in a second array radially outward of said first injectors.

5. The gas turbine combustion system of claim 4 wherein said first swirler further contains a fourth passage for directing air and fuel from said first swirler and said first and second injectors through said first opening of said dome.

6. The gas turbine combustion system of claim 5 wherein said plurality of first injectors comprises at least two injectors and said plurality of second injectors comprises at least two injectors.

7. The gas turbine combustion system of claim 6 wherein said plurality of second injectors is positioned to inject a fuel to a region proximate said passageways of said first swirler.

8. The gas turbine combustion system of claim 1 further comprising a second swirler located adjacent said aft injector assembly for imparting a swirl to a second portion of said compressed air prior to mixing with fuel in said second passage, wherein fluids in said first and second passages travel in a direction generally opposite to that of said liner.

9. A gas turbine combustion system comprising:

a casing having a first end, a second end, and a center axis, with said casing in fluid communication with compressed air from a compressor;

an end cover fixed to said casing first end, said end cover having a first swirler having a plurality of passageways extending therethrough and at least one set of injectors in fluid communication with at least one fuel source, said passageways oriented generally perpendicular to said axis, and said one set of injectors located immediately adjacent to said first swirler for injecting fuel from said one fuel source at said first swirler;

a dome located radially inward from said casing thereby forming a first passage between said casing and said dome, said dome having a first opening;

a liner located radially inward from said casing, said liner having a first part located radially inward from at least a portion of said dome, thereby forming a second passage between said portion of said dome and said first part of said liner;

an aft injector assembly located radially outward of said liner and radially inward of said casing, said aft injector assembly comprising:

a manifold having at least one injection sector;

another fuel source in fluid communication with said manifold;

a plurality of third injectors located in said manifold to inject fuel into said second passage;

a second swirler located adjacent said aft injector assembly for imparting a swirl to a second portion of said compressed air prior to mixing with fuel in said second passage, wherein fluids in said first and second passages travel in a direction generally opposite to that of said liner; and, a sleeve coaxial with said center axis and positioned radially outward of said liner and aft of said dome such as to form a fifth passage between said sleeve and said liner that is in fluid communication with said second swirler and said second passage, said sleeve having a plurality of second feed holes for directing said second portion of said compressed air to cool said liner prior to mixing with fuel from said aft injector assembly.

10. The gas turbine combustion system of claim 9 wherein said dome contains an inner dome wall and outer dome wall having a third passage therebetween.

11. The gas turbine combustion system of claim 10 wherein said outer dome wall contains a plurality of first feed holes extending from said third passage to said first passage.

12. The gas turbine combustion system of claim 11 wherein said first passage receives a first portion of said compressed air from said compressor, and said first portion of said compressed air passes through said first passage and said third passage prior to entering said first swirler.

13. The gas turbine combustion system of claim 12 wherein said first swirler is oriented such that said first portion of said compressed air passes through said plurality of passageways generally perpendicular to said center axis.

14. The gas turbine combustion system of claim 9 wherein said at least one set of injectors comprises a plurality of first injectors in a first array radially outward of said center axis and a plurality of second injectors, said plurality of second injectors in a second array radially outward of said first injectors.

15. The gas turbine combustion system of claim 14 wherein said first swirler further contains a fourth passage for directing air and fuel from said first swirler and said first and second injectors through said first opening of said dome.

16. The gas turbine combustion system of claim 15 wherein said plurality of first injectors comprises at least two injectors and said plurality of second injectors comprises at least two injectors.

17. The gas turbine combustion system of claim 16 wherein said plurality of second injectors is positioned to inject a fuel to a region proximate said passageways of said first swirler.

18. The gas turbine combustion system of claim 9 wherein said manifold of said aft injector assembly comprises four injection sectors.

* * * * *